US009994387B2

(12) United States Patent
Holford

(10) Patent No.: US 9,994,387 B2
(45) Date of Patent: Jun. 12, 2018

(54) PACKAGE FOR TOBACCO INDUSTRY PRODUCTS

(75) Inventor: Steven Holford, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 266 days.

(21) Appl. No.: 13/990,156

(22) PCT Filed: Nov. 23, 2011

(86) PCT No.: PCT/GB2011/052295
§ 371 (c)(1),
(2), (4) Date: Jul. 16, 2013

(87) PCT Pub. No.: WO2012/073001
PCT Pub. Date: Jun. 7, 2012

(65) Prior Publication Data

US 2013/0284622 A1 Oct. 31, 2013

(30) Foreign Application Priority Data

Dec. 1, 2010 (GB) ..... 1020317.2

(51) Int. Cl.
*B65D 85/10* (2006.01)
*B65D 85/12* (2006.01)
*A24F 15/00* (2006.01)

(52) U.S. Cl.
CPC ..... *B65D 85/10* (2013.01); *B65D 85/1036* (2013.01)

(58) Field of Classification Search
CPC .... B65B 19/02; B65D 85/10; B65D 85/1009; B65D 85/1018; B65D 85/1027; B65D 85/1045; B65D 85/1036; A24F 15/00
USPC ..... 206/264, 242, 271, 273–275, 272; 229/103.2, 203, 210, 124, 125.05, 87.13
See application file for complete search history.

(56) References Cited

U.S. PATENT DOCUMENTS 1,827,636 A * 10/1931 Ames ..... 229/123.2
2,242,694 A * 5/1941 Booth ..... 206/264
3,115,293 A * 12/1963 Hovland ..... 206/264
3,270,945 A 9/1966 Whitaker et al.
4,778,962 A 10/1988 Shimada
(Continued)

FOREIGN PATENT DOCUMENTS

CN 1149431 A 5/1997
CN 1280545 A 1/2001
(Continued)

OTHER PUBLICATIONS

Written Opinion of the International Searching Authority, dated Jun. 1, 2013, for International Application PCT/GB2011/052295, filed Nov. 23, 2011.
(Continued)

*Primary Examiner* — J. Gregory Pickett
*Assistant Examiner* — Rafael Ortiz
(74) *Attorney, Agent, or Firm* — Cantor Colburn LLP

(57) ABSTRACT

A package (1) for tobacco industry products comprises an elongate enclosure (2) of barrier material for enclosing a charge of tobacco products (100). An access aperture (12) is defined in the enclosure of barrier material. A moveable cover (7) is configured to extend over the access aperture (12). The moveable cover (7) comprises a graspable tab (10), and the tab is located laterally of the access aperture (12).

20 Claims, 2 Drawing Sheets

(56) References Cited

U.S. PATENT DOCUMENTS

| | | | | |
|---|---|---|---|---|
| 5,333,729 | A | 8/1994 | Wolfe | |
| 6,000,539 | A * | 12/1999 | Stewart-Cox et al. | 206/264 |
| 6,164,444 | A * | 12/2000 | Bray | B65D 75/5838 206/264 |
| 6,223,895 | B1 * | 5/2001 | Bowen et al. | 206/236 |
| 6,478,149 | B1 * | 11/2002 | Parker | 206/273 |
| 7,500,558 | B2 * | 3/2009 | Tanbo | 206/268 |
| 7,600,668 | B2 * | 10/2009 | Pham | 229/87.05 |
| 8,608,051 | B2 * | 12/2013 | Focke et al. | 229/146 |
| 8,740,049 | B2 * | 6/2014 | Tallier | 229/87.05 |

FOREIGN PATENT DOCUMENTS

| | | | |
|---|---|---|---|
| CN | 1479689 | A | 3/2004 |
| CN | 101628651 | A | 1/2010 |
| EP | 0829433 | A2 | 3/1998 |
| EP | 1 686 060 | A1 | 8/2006 |
| EP | 1 997 735 | A2 | 12/2008 |
| EP | 2 008 935 | A1 | 12/2008 |
| WO | 1989/006629 | A1 | 7/1989 |
| WO | 1998/022367 | A1 | 5/1998 |
| WO | 1998/049072 | A1 | 11/1998 |
| WO | 1999/028212 | A1 | 6/1999 |
| WO | 2001/015975 | A2 | 3/2001 |
| WO | 02/079052 | A1 | 10/2002 |
| WO | 2010/066543 | A1 | 6/2010 |

OTHER PUBLICATIONS

International Preliminary Report on Patentability, dated Jun. 4, 2013, for International Application PCT/GB2011/052295, filed Nov. 23, 2011.

International Search Report for PCT/GB2011/052295, dated Apr. 12, 2012, filed Nov. 23, 2011.

Mar. 28, 2014 Office Action and Search Report issued by State Intellectual Property Office of People's Republic of China for Application No. 201180058035.5 (including English translation).

Communication pursuant to Article 94(3) EPC (First Exam Report) dated Jun. 27, 2014 from the Examining Division for EP Application No. 11788919.6, filed Nov. 23, 2011.

* cited by examiner

PACKAGE FOR TOBACCO INDUSTRY PRODUCTS

CLAIM FOR PRIORITY

This application is a National Stage Entry entitled to and hereby claims priority under 35 U.S.C. §§ 365 and 371 to corresponding PCT Application No. PCT/GB2011/052295, entitled "A Package for Tobacco Industry Products," filed Nov. 23, 2011, which in turn claims priority to GB Application No. 1020317.2, filed Dec. 1, 2010. The entire contents of the aforementioned applications are herein expressly incorporated by reference.

The present invention relates to packaging for tobacco industry products, and in particular but not limited to, smoking articles such as cigarettes, cigars, cigarillos and loose tobacco. For convenience, these will be referred to as "cigarettes" in this specification.

Document WO98/22367 discloses a cigarette pack having a body and a hinged lid. A barrier layer forms a sealed enclosure inside the body, with an access aperture to the enclosure. It is known to provide a barrier layer as an inner wrap of a cigarette pack. The provision of a barrier layer greatly improves commercial shelf life in areas having hostile climatic conditions, especially in high temperature, high humidity areas. A cover over the access aperture is provided with a tab which can be grasped and pulled upwardly by a user to reveal the access opening. The tab is located below the access aperture. The tab may not be readily accommodated in a pack having a relatively short lid. In addition, the tab may be difficult to grasp.

The present invention provides a package for tobacco industry products as claimed in claim 1.

Thus, the tab may be more easily grasped by a user. In addition, the tab can be used in a container having a relatively short lid.

An embodiment of the present invention will now be described, by way of example only, with reference to the accompanying drawings, in which.

Figure 1:
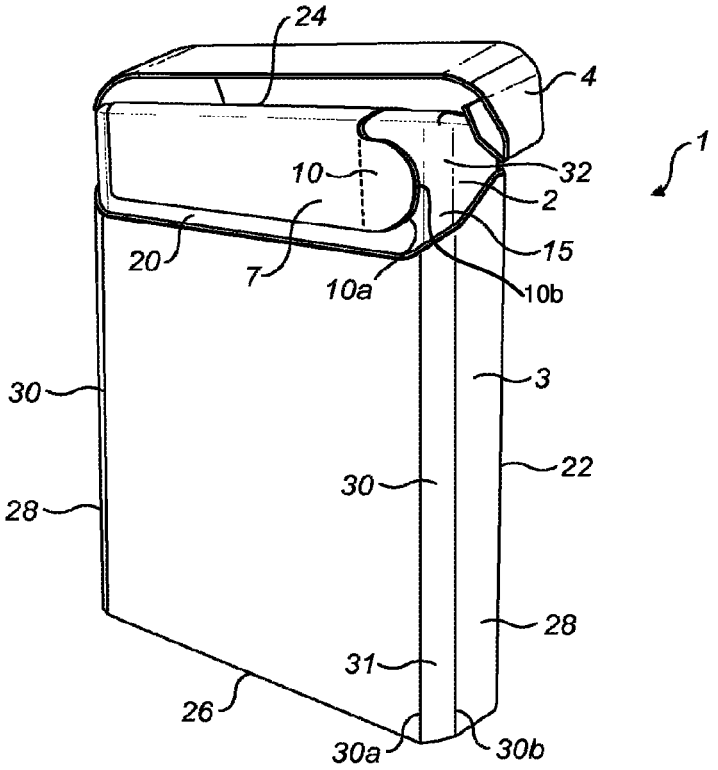
FIG. 1 is a perspective view of the package in a preferred embodiment of the present invention, with the container lid open and the cover closed.

FIG. 1 shows a package 1 for tobacco industry products according to a preferred embodiment of the present invention. The package 1 includes a sealed charge or enclosure 2 for containing a tobacco product, preferably cigarettes. The sealed charge 2 is disposed within a container having a body 3 and a hinged lid 4.

The container and charge 2 are substantially in the shape of an elongate cuboid having a front face 20, rear face 22, top face 24, bottom face 26 and side faces 28. A longitudinal direction is defined passing through top and bottom faces 24, 26 and parallel to the front and rear faces 20, 22, and side faces 28. A lateral direction is defined as passing through the side faces 28, and parallel to the plane of the front and rear faces 20, 22 and top and bottom faces 24, 26.

The body 3 and lid 4 of the container have edges 30 extending longitudinally between the front face 20 and side faces 28. The edges 30 define a connecting surface, connecting the front face and side face. The edges 30 are preferably bevelled or rounded. FIG. 1 shows a bevelled edge 30, comprising a planar bevel connecting surface 31 between a first edge 30*a* adjacent the front face 20, and a second edge 30*b* adjacent a side face 28. The planar bevel surface 31 extends longitudinally along the whole length of the body 3 and lid 4. The planar bevel surface 31 extends at an angle to the adjacent front face 20 and side face 28.

The charge 2 has a matching bevelled or rounded edge. FIG. 1 shows the charge 2 with a bevelled edge, having a planar bevel surface 32 coincident with the planar bevel surface 31 of the container. The bevelled edges are defined by first and second edges coincident with the first and second edges 30*a*,30*b* of the container. Preferably, both longitudinal side edges of the container and enclosure are similarly bevelled.

The sealed charge 2 comprises a charge of cigarettes which are optionally located in an inner frame (not shown). The charge 2 further comprises a layer of barrier material 15, which provides a sealed enclosure around the cigarettes and, if present, the inner frame. The enclosure formed by the barrier material 15 has an access opening through which cigarettes can be removed.

Figure 2:
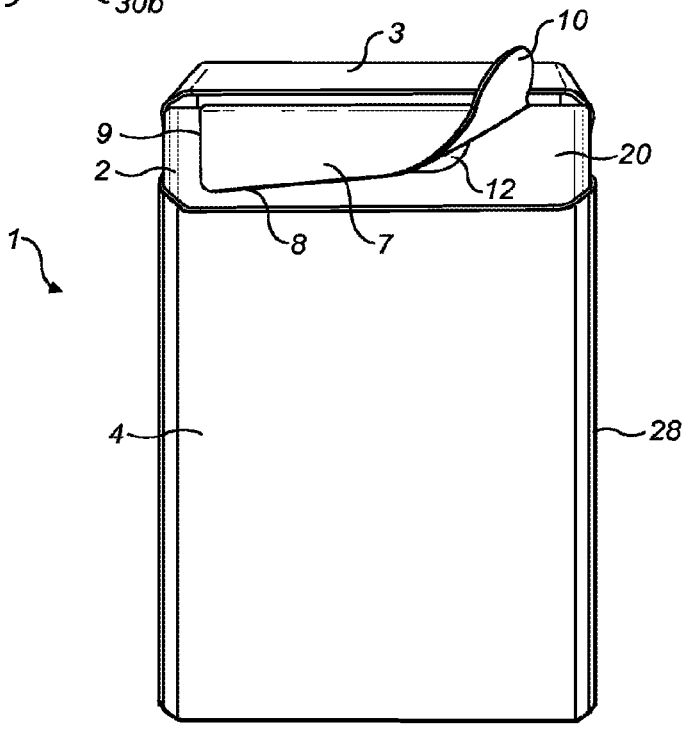
FIG. 2 is a perspective view of the package of FIG. 1, with the container lid open and the cover in a partially open position.
Figure 3:
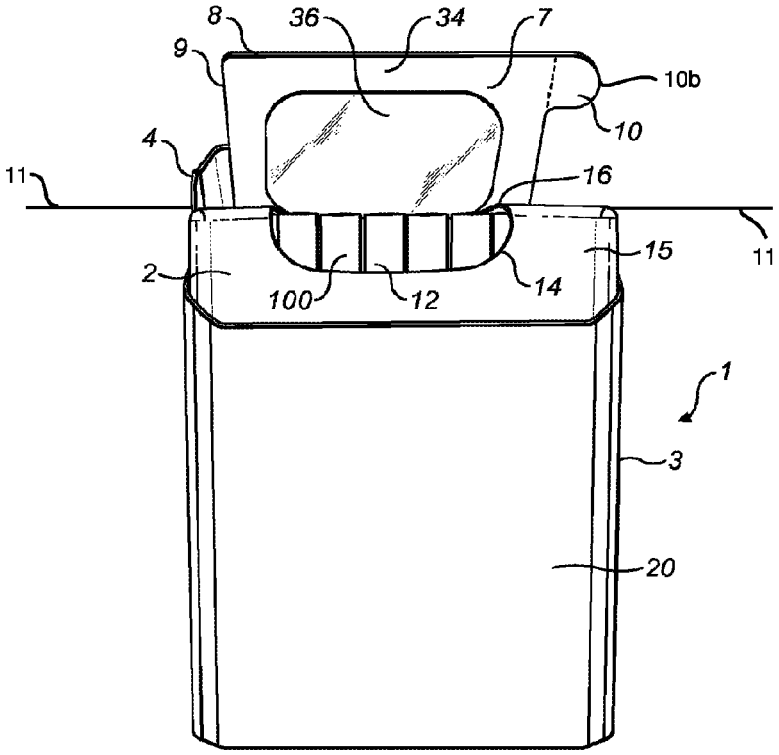
FIG. 3 is a perspective view of the package of FIG. 1, with the container lid open and the cover open.

FIGS. 2 and 3 show the package in a partially and fully opened state respectively. The charge 2 comprises a re-sealable cover 7 for covering the access opening. The cover 7 is in the form of a flap attached to a rear face 22 of barrier material of the charge 2. The cover 7 covers the whole of the access opening. The cover 7 is revealed when the lid 4 of the outer container is opened.

The cover 7 is provided with a tab 10. The tab 10 is dimensioned to be grasped by a user to open the cover 7 and reveal the access opening 12 in order to remove a cigarette.

The tab 10 is located laterally of the access opening 12. In particular, the graspable tab 10 is located between the access opening 12 and a side face 28. A bottom edge of the tab 10 is preferably coincident with a bottom edge of the cover 7, which preferably extends below the access opening.

A side edge 10*a* of the tab 10, laterally distal to the access opening, is preferably substantially aligned with bevelled or rounded edge 30. In particular, the side edge 10*a* of the tab 10 overlies the charge 2 at a point coincident with the edge along which the planar front face 20 of the enclosure meets the bevelled edge, i.e. angled edge 32 of the enclosure. Thus, the side edge 10*a* of the tab 10 is aligned with the edge 30*a* of the front face 20 of the enclosure. The lateral end 10*b* of the tab distal from the access aperture is substantially coincident with a longitudinally extending edge of the front face of the enclosure.

The side edge 10*a* of the tab 10 is preferably rounded. The references to the alignment of the side edge 10*a* of the tab 10 refers to alignment of the distal point, or apex, of the tab 10 in a lateral direction.

FIG. 2 shows the package 1 in the process of being opened. The lid 3 has been pulled backwards to be fully opened. The tab 10 has been lifted upwardly and forwardly to raise the cover 7. The movement is easily accomplished by a user gripping the tab 10 adjacent a side edge face 28 of the package 1.

The tab 10 is dimensioned to be readily grasped by a user. The tab 10 has an area which is not adhered to the enclosure and so may be easily lifted. The tab 10 is preferably located on a right side of the cover, as seen when facing the front face 20. The cover 7 extends beyond the access opening 12 on a lateral side opposite to the side having the tab 10. The extension of the cover on the opposite side does not define a tab because the cover is not dimensioned to be grasped on the opposite side, and the opposite side is releasably adhered to the enclosure adjacent to its edge 9.

FIG. 3 shows the package 1 in an open state, in which the lid 3 and cover 7 have both been lifted. The access opening 12 extends on the front face 20 as defined by edge 14, and on the top face 24 as defined by edge 16. The moveable cover 7 has a front edge 8 which extends beyond the front edge 14 of the access opening 12. The cover 7 has side edges 9 which extend beyond side edges 16 of the access opening 12.

The cover 7 and/or front face 20 and top face 24 are provided with a re-sealing means to releasably connect the cover 7 to the charge 2. Preferably, the resealing means is a permanently tacky adhesive on the cover and/or on the front face 20 and top face 24 of the charge 2. The permanently tacky adhesive is located adjacent to the access opening 12, and preferably extends around all sides of the access opening. The tab 10 is at least partly free of the adhesive, and overlies a front side 20.

The cover 7 extends longitudinally beyond the access opening 12 on a front face, as defined by edge 8. This extension of the cover longitudinally on the front face does not define a tab because the cover is not dimensioned to be grasped in this area, and this area of the cover is releasably adhered to the enclosure adjacent to its edge 8.

A plurality of smoking articles 100 are shown in the enclosed barrier material 15. The smoking articles 100 are preferably cigarettes or may be cigars, cigarettes or loose tobacco, or may be any other suitable tobacco industry product.

The cover 7 may comprise an inner layer 36 and an outer layer 34. The outer layer 34 is preferably a layer of barrier material permanently adhered to the barrier material forming the rear face 22 of the charge 2. The tab 10 is preferably integrally formed with the outer layer 34. The outer layer 34 defines the maximum extent of the cover 7, as defined by edges 8, 9. The adhesive forming the resealing means may be located on a part of the outer layer 34 extending beyond the inner layer 36.

The inner layer 36 is preferably integrally formed with the barrier material 15 forming the charge 2. The inner layer 36 is preferably permanently adhered to the outer layer 34. The inner layer 36 has dimensions matching the access opening 12. The inner layer 36 and access opening 12 may be formed together by forming cuts along edges 14, 16. The edges 14, 16 may be perforated initially, and permanent separation may occur when the cover 7 is opened for the first time.

Alternatively, the moveable cover 7 may be formed as a single layer attached to, or integrally formed with the barrier material 15 of the charge 2.

The access aperture 12 is preferably asymmetrically positioned on the enclosure in a lateral direction. The access aperture 12 is not located centrally, and is further from the side face 28 adjacent the tab 10 than the side face 28 on the opposite side to the tab 10. This asymmetric position provides for increased lateral space for the tab 10, between the access aperture 12 and the side face 28

The smoking articles 100 are removable from the enclosure in a longitudinal direction through the access aperture 12 in the top face 24. In addition, the smoking articles are removable from the container in a longitudinal direction. The tab 10 is located laterally of the access aperture 12 relative to the direction of removal of the smoking articles 100.

The cover 7 opens in the substantially longitudinal direction, by a rotational movement about an axis, which is a laterally extending line 11. The cover 7 is in the form of a flap attached to, or integral with, a rear face 22 of the enclosure 2. In particular, the cover 7 is moveable around a laterally extending line 11 on the rear face 22 of the enclosure. The tab 10 is located laterally of the access aperture 12, in a direction parallel to the rotational axis of the cover 7.

The container lid 4 is moveable in a substantial longitudinal direction to open the container, by rotation about a further rotational axis, which is a laterally extending line. In particular, the lid 4 is moveable around a laterally extending line on the rear face container body 3. The tab 10 is located laterally of the access aperture 12, in a direction parallel to the rotational axis of the lid 4.

Figure 4:
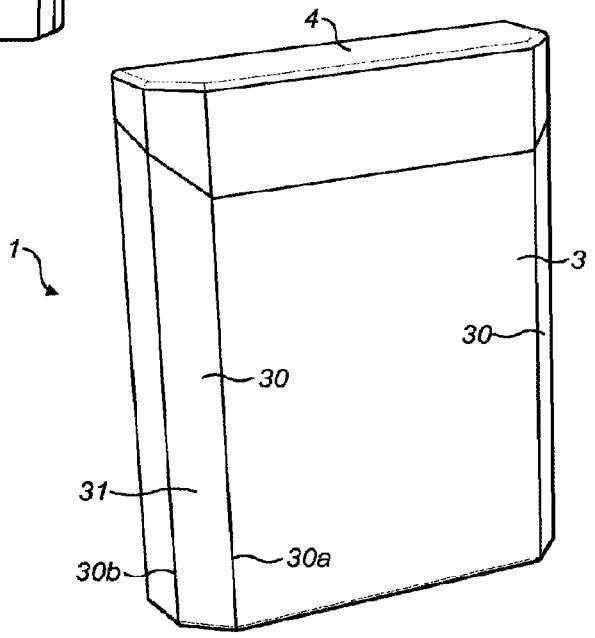
FIG. 4 is a perspective view of the package of FIG. 1, with the container lid closed.

FIG. 4 shows the container in a closed state, with the lid 4 pivoted downwardly into abutment with the body 3. The bevelled or rounded edge 30 extends continuously on each front longitudinal edge of the body 3 and lid 4. The bevelled edges comprise a first edge 30*a* adjacent to the front face 20, and a second edge 30*b* adjacent a side face 28. The planar bevel surface 31 extends longitudinally along the whole length of the body 3 and lid 4 on each longitudinal side.

The lid of the container must extend over the cover 7 and tab 10. The lateral location of the tab 10 relative to the access aperture allows a relatively short lid of the container, in a longitudinal direction. In addition, the proximity of the tab 10 to a side face of the enclosure allows a user to grasp the tab 10 after, or while, being guided by contact with the adjacent side face.

The tab has been described as having a lateral end 10*b* distal from the access aperture which is substantially coincident with a side edge of a front face of the enclosure, in particular, a side edge 30*a* between the front face and the planar surface of the bevelled edge. Alternatively, the tab 10 may extend laterally beyond the edge 30*a*, and overlie the connecting, i.e. bevel, surface 32. Alternatively, the tab 10 may extend laterally up to or beyond the side face 28 of the package, or overlie the front face 20.

The container and enclosure have been described as having bevelled side edges. Alternatively, the side edges may be rounded. An elongate rounded surface extends longitudinally and connects the front face with a side face. The side edges may be defined by first and second edges substantially as described, which in this embodiment define a boundary between the front face and curved surface, and curved surface and side face, respectively. The enclosure has corresponding rounded side edges. The distal edge of the tab may be similarly aligned with the edge of the front face of the enclosure, in particular aligned with the boundary between the front face of the enclosure and the curved surface of the rounded edge.

Alternatively, the tab may extend laterally beyond that edge, and overlie the rounded surface of the enclosure. Alternatively, the tab may extend laterally up to or beyond the side face of the enclosure, or overlie the front face.

Alternatively, the container and enclosure may have substantially squared side edges. The distal end 10*a* of the tab 10 may be aligned with a squared edge. Alternatively, the side edges of the enclosure and/or container may have any type of longitudinal side edges, in which the front face and side faces are spaced apart by a connecting surface of any curvature or shape. The distal end 10*a* of the tab 10 may be aligned with the boundary between the front face and the connecting surface.

The package has been described as having side edges of the enclosure and/or container which are rounded, bevelled or have another shape having a connecting surface. Alternatively, the enclosure and/or container may comprise only one side edge which is rounded, bevelled or has another shape having a connecting surface. Preferably, the rounded, bevelled or other shaped connecting surface is on the side adjacent to the tab 10. The other side edge may have a different shape, and in particular, may have a simple square edge directly joining the front face and side face.

The package preferably comprises a relatively rigid outer container having a hinged lid, in which the enclosure of barrier material having a cover and a side tab is located. Alternatively, the package may comprise the enclosure and moveable cover with tab, without an outer container. Alternatively, the enclosure with cover and lateral tab may be located within a different type of outer container.

Any of the features described in any embodiment may be present in association with any other features of any other embodiment.

The invention claimed is:

1. A package for tobacco industry products, comprising:
an elongate enclosure of barrier material;
an access aperture defined in the enclosure; and
a moveable cover configured to extend over the access aperture, the moveable cover comprising a graspable tab;
the access aperture extending on a front face and a top face of the enclosure;
the moveable cover having a front edge which extends below a front edge of the access aperture such that the front edge of the moveable cover is disposed on the front face of the enclosure;
wherein the front edge of the access aperture is a lowermost edge of the aperture;
the cover having side edges which extend beyond side edges of the access aperture;
wherein the tab is located laterally of the access aperture; and
wherein the front edge of the moveable cover is moveable along with the cover into an open position in which the access aperture is exposed and into a closed position where the cover extends over the access aperture.

2. The package as claimed in claim 1, further comprising a container, wherein the enclosure of barrier material is located within the container.

3. The package as claimed in claim 2, wherein the container comprises a body and a lid; and wherein the lid is hinged to the body.

4. The package as claimed in claim 2,
wherein at least one of the enclosure and the container has a front face having at least one longitudinal side edge defining a connecting surface between the front face and at least one side face.

5. The package as claimed in claim 1, wherein a lateral end of the tab distal from the access aperture is substantially coincident with a side edge of the enclosure.

6. The package as claimed in claim 1,
wherein a lateral end of the tab distal from the access aperture is substantially coincidental with a longitudinally extending edge of a front face of the enclosure.

7. The package as claimed in claim 4, wherein a lateral end of the tab distal from the access aperture is substantially coincident with a first side edge defining a boundary between a front face of the enclosure and the connecting surface.

8. The package as claimed in claim 1, wherein the tab overlies the front face of the enclosure.

9. The package as claimed in claim 1, wherein the tab is integrally formed with the moveable cover.

10. The package as claimed in claim 1, wherein the cover is a flap attached to the enclosure of barrier material.

11. The package as claimed in claim 1,
wherein the cover comprises an outer layer and an inner layer;
wherein the tab is integrally formed with the outer layer and
wherein a rear face of the enclosure of barrier material is integrally formed with the inner layer.

12. The package as claimed in claim 1, wherein the access aperture is asymmetrically positioned on the enclosure in the lateral direction.

13. The package as claimed in claim 4, wherein the connecting surface defines a beveled side edge.

14. The package as claimed in claim 4, wherein the connecting surface defines a rounded side edge.

15. The package as claimed in claim 7,
wherein the lateral end of the tab distal from the access aperture is substantially coincident with a first side edge between the front face and a bevel forming the longitudinal side edge.

16. The package as claimed in claim 7, wherein the lateral end of the tab distal from the access aperture is substantially coincident with a first side edge between the front face and a bevel forming the longitudinal side edge.

17. A package for tobacco industry products, comprising:
an elongate enclosure of barrier material;
an access aperture defined in the enclosure; and
a moveable cover configured to extend over the access aperture, the moveable cover comprising a graspable tab;
the access aperture extending on a front face and a top of the enclosure;
the moveable cover having a front edge which extends below a front edge of the access aperture such that the front edge of the moveable cover is disposed on the front face of the enclosure;
the cover having side edges which extend beyond side edges of the access aperture;
wherein the tab is located laterally of the access aperture; and
wherein the package further comprises an inner frame disposed within the elongate enclosure of barrier material.

18. The package as claimed in claim 17, wherein the package further comprises a container in which the elongate enclosure of barrier material is disposed, the container including a hinged lid extending over an opening, where the lid is moveable between a closed position and an open position in which the elongate enclosure of barrier material may be accessed through the opening.

19. A package for tobacco industry products, comprising:
an elongate enclosure of barrier material;
an access aperture defined in the enclosure; and
a moveable cover configured to extend over the access aperture, the moveable cover comprising a graspable tab;
the access aperture extending on a front face and a top face of the enclosure;
the moveable cover having a front edge which extends below a front edge of the access aperture such that the front edge of the moveable cover is disposed on the front face of the enclosure;
the cover having side edges which extend beyond side edges of the access aperture;
wherein the tab is located laterally of the access aperture; and
wherein the moveable cover is re-sealable.

20. The package as claimed in claim 19, wherein at least one of the cover, the front face of the elongate enclosure of barrier material, and the top face of the elongate enclosure of barrier material includes an adhesive material such that the moveable cover is said re-sealable.

* * * * *